US005343898A

United States Patent [19]

Fredriksson

[11] Patent Number: 5,343,898

[45] Date of Patent: Sep. 6, 1994

[54] METHOD AND APPARATUS FOR THREADING-UP YARN IN A PULSATING MANNER

[75] Inventor: Lars-Berno Fredriksson, Kinna, Sweden

[73] Assignee: IRO AB, Ulricehamn, Sweden

[21] Appl. No.: 952,848

[22] PCT Filed: Apr. 17, 1991

[86] PCT No.: PCT/SE91/00274

§ 371 Date: Nov. 24, 1992

§ 102(e) Date: Nov. 24, 1992

[87] PCT Pub. No.: WO91/16483

PCT Pub. Date: Oct. 31, 1991

[30] Foreign Application Priority Data

Apr. 17, 1990 [SE] Sweden ..... 9001376-4
Apr. 25, 1990 [SE] Sweden ..... 9001516-5

[51] Int. Cl.[5] ..... D03D 47/30; D03D 47/34

[52] U.S. Cl. ..... 139/450; 139/435.4; 139/435.1

[58] Field of Search ..... 139/435.4, 435.1, 452, 139/450

[56] References Cited

U.S. PATENT DOCUMENTS 4,436,122 3/1984 van Mullekom .
4,550,752 11/1985 Manders .
4,643,233 2/1987 Manders .
4,989,644 2/1991 Tanaka et al. ..... 139/116.2
5,016,676 5/1991 Fourneaux et al. ..... 139/116.2
5,119,863 6/1992 Okesaku et al. ..... 139/435.4

FOREIGN PATENT DOCUMENTS 0307885 3/1989 European Pat. Off. .
0354300 2/1990 European Pat. Off. .
0362925 4/1990 European Pat. Off. .
0420176 4/1991 European Pat. Off. .
3145326 9/1989 Fed. Rep. of Germany .
WO90/11396 2/1990 World Int. Prop. O. .

*Primary Examiner*—Andrew M. Falik
*Attorney, Agent, or Firm*—Flynn, Thiel, Boutell & Tanis

[57] ABSTRACT

A thread feeding system including a thread regulator having a fixed housing, a hollow rotatable shaft extending through the fixed housing, a rotatable winding section secured to the rotatable shaft, an angled thread duct extending through the thread regulator, an inlet positioned at an upstream end of the duct, and ejectors positioned along the duct portions. The ejectors supply a working medium from a pressurized working medium source to the duct to facilitate threading of a thread through the thread duct. The inlet receives a free end of the thread from a thread spool assembly positioned upstream from the thread regulator. The feeding system also includes an arrangement for controlling the ejectors so that the ejectors generate a pressure proximate to the inlet to develop a flow of the working medium into the inlet, and an arrangement for feeding the thread through the thread regulator in a pulsating manner to insure that the free end of the thread passes unobstructed through the thread duct.

32 Claims, 7 Drawing Sheets

METHOD AND APPARATUS FOR THREADING-UP YARN IN A PULSATING MANNER

FIELD OF THE INVENTION

The present invention relates to a device designed to facilitate the threading of yarn into a yarn feed system consisting of thread regulator and intake thread brake. The thread regulator is thereby of the type known per se which is preferably equipped with a yarn winding sheave with attached feed tube for the yarn, which sheave is fixed to a centrally located and rotatable shaft. A first duct is made in the said shaft, this first duct being connected to a second duct in the yarn winding part. The intake thread brake has an intake aperture through which yarn enters from a yarn spool or similar yarn supply. Depending on the controls/control signals from one or more control units, one or more ejectors located in or on the said first and second ducts secure(s) the yarn feed in the first and second ducts by ensuring that a medium pressure ratio accomplishing the yarn feed prevails in the first and second ducts. The said controls may control one or more connections from one or more pressure sources to the said ejector/ejectors.

The invention also relates to a process for facilitating the threading of yarn into a yarn feed system consisting of the said intake thread brake and thread regulator where the thread regulator includes first and second ducts, in or onwhich one or more ejectors are positioned in such a way as to ensure that a medium pressure ratio which accomplishes the yarn feed into the thread regulator occurs in the first and second ducts.

BACKGROUND OF THE INVENTION

Accomplishing the yarn feed through a thread regulator by mechanical means with the aid of a preferably flexible needle-shaped element is already known. Accomplishing the threading process by means of ejectors/nozzles in parts of the yarn feed path which extends through various elements in the yarn feed system, is also known. Thus a nozzle or ejector arrangement in the actual thread regulator, by means of which the end of the yarn is introduced via an intake aperture, and the nozzles or ejectors are thereafter acted upon in order to obtain the threading function, is also known.

Making use of the intake thread brake (in relation to the thread regulator) in the yarn feed path and locating the intake brake in connection with the thread regulator is also known. In the known arrangements, a number of transducers are often used which are intended to indicate the positions (presence) of the yarn on its path through the particular elements in the yarn feed system. So-called controlled brakes on the intake side of a thread regulator are also already known. Brakes of this type facilitate variations in the yarn brake parameters and the brake in question often works on the "on-off" principle.

One requirement is to be able to achieve an effective threading function which, for the major part at least, runs automatically. The threading function is therefore to be capable of including yarn control function(s) at the exit from the thread regulator, so that further feeding can be accomplished through any subsequent exit thread brake as far as the textile machine using the thread, especially a loom.

There is also a requirement that the yarn delivery system should be capable of containing as few components as possible and one objective expressly stipulated in certain contexts is that the number of transducers/sensors for detecting the presence (positions) of the yarn should be as small as possible.

A simple and unambiguous handling of the yarn threading function is desirable, particularly in view of the fact that malfunctions can occur when the textile machine/loom is operating, especially breaking of the yarn. One ob3ect of this invention, therefore, is to achieve an entirely automatic threading process, or at least one which is automatic in many sections. Having a yarn cleaning process forwards and/or backwards on the thread path prior to the threading process should achieve the simplified handling and construction desired. Achieving such threading and yarn cleaning processes is a complex technical problem to which the present invention affords a solution.

One problem in devising an effective threading function in a yarn path of this type is obtaining an efficient transfer of the yarn between the intake thread brake and the thread regulator. Normally there is a relatively large gap between the said brake and the thread regulator. The invention takes account of those cases in which the intake thread brake is located closer to the thread regulator. In such cases it is a question of achieving an appropriate thread-bearing and thread delivering medium flow in which the end of the yarn and following parts of the yarn can be connected to the thread regulator's intake (inlet). In any opening of a medium passage for supporting and delivering the yarn/end of the yarn, there are problems in preventing the end of the yarn from shifting to the side and leaving the predetermined direction. The present invention is directed towards solving even this problem.

In what can essentially be regarded as the main characteristic of a device according to the invention, among other things, the intake brake is connected to the rear section of the thread regulator and, by using one or more ejectors, a production medium flow is developed on the end of the yarn/the yarn which, on applying/presenting/positioning the free end of the yarn against the intake brake aperture, causes it to be fed in through the said aperture, carried through the intake brake and introduced into the first duct in the thread regulator through its intake orifice. The strand of yarn can thereby be carried through the parts of the intake brake serving for actual braking, or in an initial phase past these, before then undergoing in a subsequent phase a simple stretching or suitable lateral adjustment as it is led in from the side into the active parts of the brake. The intake thread brake may be assigned one or more ejectors of its own and/or utilize one or more ejectors in or on the thread regulator's first and second ducts. The ejector(s) is/are controlled by connected control unit(s) and, depending on its controls, give rise to an initial medium pressure at the orifice of the first duct facing onto the intake thread brake which is lower than a second medium pressure at or behind the said aperture on the intake thread brake for development of the production medium flow.

In one embodiment of the object of the invention, the intake thread brake includes a controllable brake element, by means of which the braking force acting on the yarn can be varied and/or applied and relaxed. When applying (positioning) the end of the yarn to the intake thread brake, the brake element is deactivated by means of an appropriate control unit or a manually operated mechanical operating device, and remains entirely or partially (temporarily) deactivated during any threading process. In a preferred embodiment, the intake thread brake and the thread regulator are controlled when in operation (weaving), whereas during the threading process the intake thread brake can be separately controlled. The relevant controls are achieved by means of one or more of the said units.

In one embodiment, control of the yarn within the intake thread brake and thread regulator is coordinated with control of the yarn before the brake and after the thread regulator. Consequently in this case there is a preferably automatic element, which carries any free yarn end to the insertion position in front of the intake thread brake aperture. Thereupon (or an instant before) the said ejector/ejectors in the brake and thread regulator is/are actuated for feeding the yarn through into these units. On the thread regulator's exit side there are other automatic elements which take up the ejected end of the yarn and carry this on to any subsequent outlet brake and the textile machine.

One or more control units control the first and second elements and the entire threading process is thus fully automated.

In one embodiment, propulsion along a first and second thread feeding line is proposed. An initial thread feed resistance may thereby be present in the first line, and the second line presents curves through which the end of the yarn must pass. The rate of yarn feed may therefore exceed the maximum rate which the end of the yarn should have when passing through any curves. During such passage the thread's rate of advance when threading would thus have to be reduced, at least temporarily. In the first case this is brought about by activating the brake element in the intake thread brake, which activation is effected by a control unit. In the second case the impelling medium flow is influenced by controlling the ejectors (the supply of impelling medium to the ejectors). Pulsating impelling medium for the yarn are thereby conceivable.

In a preferred embodiment, the intake thread brake is assembled together with the thread regulator on the latter's rear section (end), in such a way that the yarn path in the brake lies essentially in line with the intake opening of the first duct. The intake thread brake can thereby be fitted with a shell section which essentially encloses the brake element and the thread feed path tightly, so that a sealed common chamber exists enclosing the said chamber and the first and second ducts. In another embodiment, the brake element is open to the surrounding atmosphere, affording easy manual access for the removal of dust, carrying out servicing etc.

A special control function is available on the version with an essentially sealed inner chamber in the intake thread brake. Advance suction of air in the common chamber is to be performed with the ejector function(s) in order to produce stable flow conditions in the yarn path before the actual threading function is commenced, thereby eliminating the spontaneous oscillation phenomenon in any remaining air.

A process according to the invention involves the phase in the respective threading cases, in which the free end of the yarn is applied to the inlet aperture of the intake thread brake, the yarn end in the case of threading after yarn fracture being applied to the aperture after the yarn cleaning facility of the respective element before and/or after the intake yarn brake or thread regulator has been operated or actuated for cleaning the yarn behind or ahead of the remaining/existing yarn in the intake thread brake and/or in the thread regulator. Further phases in the process involve the actuation of the ejector(s) applied in the intake yarn brake and/or one or more of the said ejectors on or in the first and second ducts by means of the application of medium pressure source(s) together with the development of a yarn producing medium flow generated by the ejector/ejectors and drawing the end of the yarn in through the aperture in the intake thread brake, through the brake and into the first duct.

In further developments of the new process according to the invention the automatically functioning yarn-applying element is influenced/controlled in such a way that the end of the yarn is automatically carried towards the brake's intake aperture. On leaving the thread regulator, the automatic catcher is induced to catch the end of the yarn and to guide this towards the textile machine, in particular the loom, via any controlled or uncontrolled exit thread brake positioned after the thread regulator.

The automatic threading processes are controlled by one or more units for controlling the yarn feed system and/or the textile machine.

The construction described above provides effective threading functions which can be performed fully automatically and which can, moreover, function with preparatory cleaning processes, preferably automatic ones, prior to the respective threading process. Even complex threading paths can be incorporated in connection with the thread regulator and intake brake. Acceleration and retardation of the yarn during the respective on threading process can be achieved by controlling the conveying medium flow, which opens up the possibility for technically simply constructed solutions for yarn feed on threading. The equipment can be controlled from the control unit(s) of the thread regulator(s) and intake brake(s) and/or the textile machine, in particular the loom. A transducer can be used to indicate the carrying out of threading, yarn breaks, etc. In one embodiment, the end of the yarn can be furnished with an applicable element, which is to some extent coordinated with the respective duct wall as the yarn is delivered. This element, for example a spherical one having a certain flexibility, is positioned so as to cause a relatively large pressure differential in front of or behind the end of the yarn fitted with the said element, thereby assisting appropriate propulsion of the yarn in the respective duct. The ball/element can be automatically removed, for example cut off, by means of a removing/cropping element at a suitably predetermined point along the yarn path. An air suction effect may be provided in the ducts in the brake and thread regulator/winding pipe by means of an ejector on the exit aperture of the winding pipe, on the exit eye, etc. A static air flow can exist and (a) dynamic air flow(s) may be temporarily applied. The medium pressure will be lowest in front of the leading yarn end. Threading of two or more "parallel yarns" (running parallel side by side) may be performed with the proposed equipment. In the same way the parallel yarn tracks can also be led through the same intake thread brake or alternatively via each's own brake.

BRIEF DESCRIPTION OF THE DRAWINGS

A currently proposed embodiment of a process and a device according to the invention will be described below, referring to the enclosed drawings in which.

DETAILED DESCRIPTION

Figure 1:
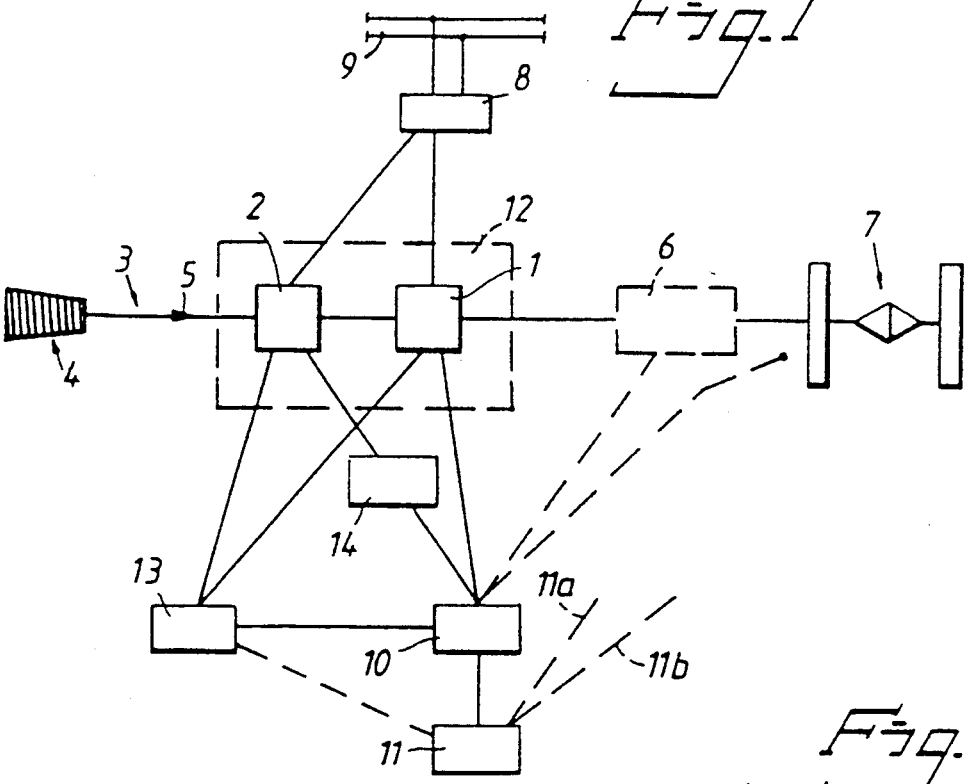
FIG. 1 shows a general diagram of threading equipment at intake thread brake and thread regulator.

In FIG. 1, 1 denotes a thread regulator and 2 an intake thread brake for a yarn 3 (or more than one yarn running parallel) which is fed from a spool/a spool rack 4 in the direction of the arrow 5. An exit brake for the yarn running from the thread regulator is indicated by 6 and a textile machine, especially a loom, by 7. The brake 2 and the thread regulator 1 are powered (electrically or otherwise) from a power supply unit 8 of conventional type which is normally connected to an electrical mains network 9. The functions of the brake and the thread regulator are controlled from a control unit/control system 10, which may also be arranged so as to control the exit brake 6 and the textile machine 7.

The control system may either contain or be connected to an overriding master unit 11, which controls all the items of machinery and ancillary attachments, symbolised by connections 11*a*, 11*b*. The invention relates to the threading and cleaning functions for thread regulator and brake, the interconnections of which are indicated by 12. The threading function works with compressed air or air suction functions/ejector function(s), the medium source element, whose connection can be controlled by the control system and/or the master unit, being denoted by 13. The brake 2 is preferably of the controllable brake type and is therefore connected to a brake control unit/brake control system 14, which in turn is connected to the unit 10 (and/or 11).

A

Figures 2, 2A, 2B, 2C, 2D:
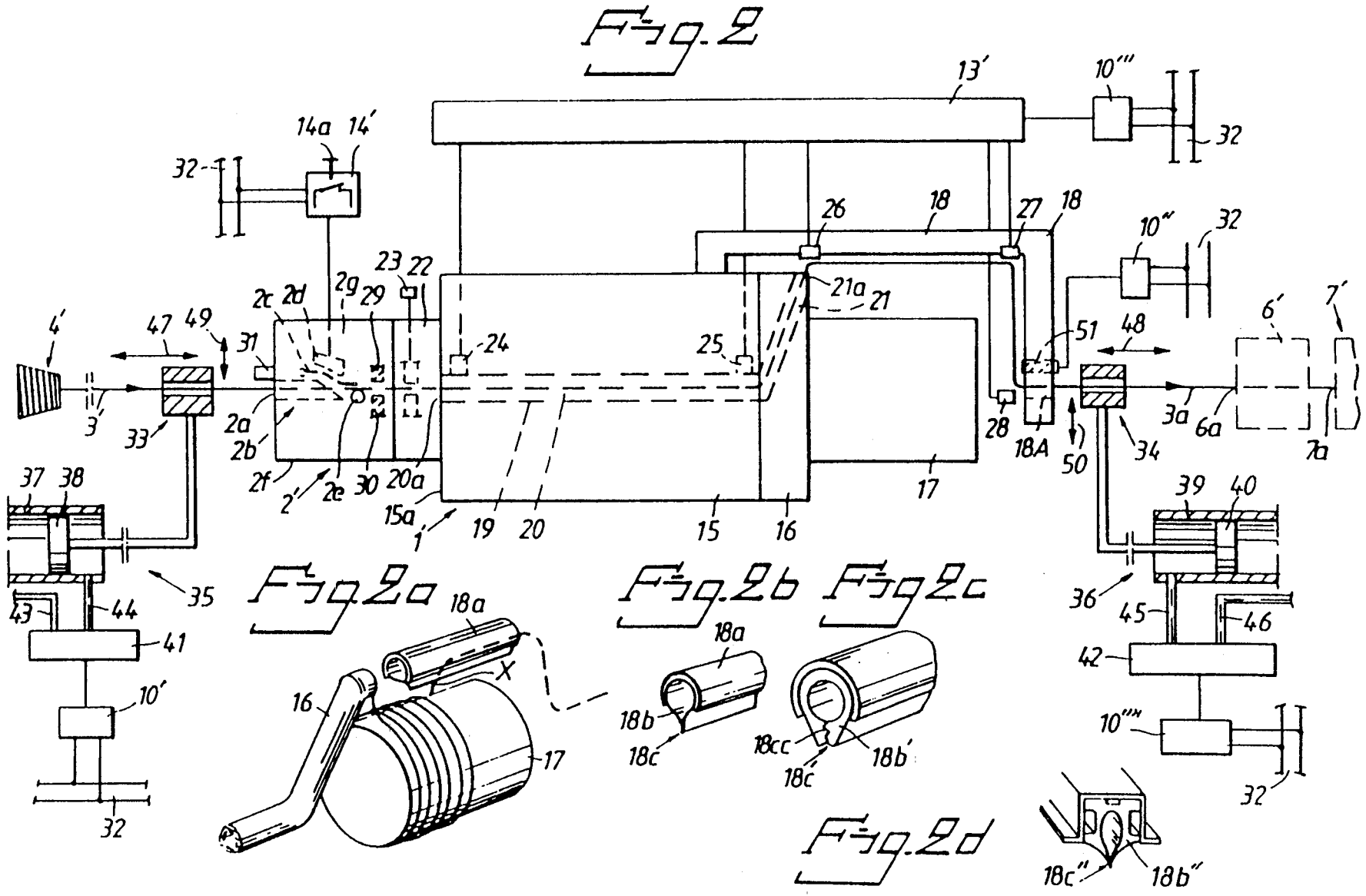
FIG. 2 shows the threading function in somewhat more detail than FIG. 1, with the addition of a cleaning element which can be actuated before the respective threading process.
FIGS. 2*a*–2*d* show details of various embodiments of a part which guides the yarn over the yarn storage section in the thread regulator.

According to FIG. 2, the thread regulator is of known type, for example of a type supplied to the general market by the applicant, which includes a shell/motor section or housing 15, with winding section (winding sheave with winding tube) 16, a yarn storage section 17 and an overlying section 18. The winding section is fixed to a central, longitudinal inner shaft 19 which can rotate in the thread regulator in a manner known per se. The shaft 19 incorporates a longitudinal first duct 20 which is connected to a second duct 21 in the winding tube. The inlet of the first duct is shown by 20*a* and the outlet of the second duct by 21*a*. The inlet of the intake brake 2′ is shown by 2*a*. A transducer 22, of a type known per se, may be included between the brake and the thread regulator, for example a yarn movement transducer of the type supplied to the general market by the Swedish company ELTEX, with a manual actuating element 23 for "opening" the transducer (for example to facilitate the threading of yarn through this). The transducer 22 may alternatively by located "upstream" of the intake brake, so that it can make possible detection of any fault which has occurred in the intake brake, which may be particularly important if the brake is of the "covered" type (see later in the description). One or more ejectors of known type may be used on the yarn path. Possible locations within the thread ducts are shown by 24, 25, 26, 27, 28, 29, 30, 31. In FIG. 2, parts of the control unit which are connected to the control unit 10 (FIG. 1) are denoted by 10′, 10″, 10‴, 10⁗. The control units or parts thereof may be connected to a common connection 32, e.g. thread connection which leads to an overriding control unit and between the units.

The brake element of the intake brake 2′ is indicated by 2*b* and may include a leaf spring arrangement 2*c* operated by electrical means, e.g. by an electromagnetic element 2*d*. Depending on the controls (control signals), the leaf spring(s) press(es) the yarn with greater or lesser force against a support 2*e*. The leaf spring/the brake element may be manually deactuated by means of a manual operating element 14*a* and is also positioned so as to produce varied control and/or on and off switching functions in the braking and as a function of automatic controls (control signals) from an associated part 14′ of the control unit. One or more ejector elements of the elements 24–31 are used according to the function required.

The yarn 3′ is led via duct part(s) in the intake brake, through any transducer element 22 used and in via the inlet 20*a*. Thereafter the yarn is taken on through the first andsecond ducts 20,21 to the outlet 21*a*. The yarn is taken further along the section 18 to the thread regulator's outlet aperture 18*a*.

FIGS. 2*a*, 2*b*, 2*c*, and 2*d* show in more detail some of the currently preferred embodiments of the section 18 in the thread regulator, designed to ensure winding of the yarn on the yarn storage part 17 after threading, particularly if the exit brake towards the doffing end of the thread regulator is not working.

Part 18, which may alternatively be located below instead of above the yarn storage section 17, is therefore formed here by a slotted thread tube 18*a* running towards the yarn storage section 17, which tube, as will be seen more clearly from FIGS. 2*b* and 2*c*, incorporates a preferably flexible (for example of suitable PVC, polyurethane, nitrile rubber, etc.) insert-like part 18*b* or 18*b*′ (18*b*″ in FIG. 2*d*), having an aperture 18*c* or 18*c*′, ch part is suitably inserted whilst pretensioned in the thread tube 18*a*, in such a way that the aperture 18*c* is closed normally. When threading takes place, the thread tube 18*a* with its insert 18*b* thus forms an essentially closed thread duct for safely transferring the yarn to the exit part of the thread regulator. When winding of the yarn onto the yarn storage section 17 commences on completion of threading, the pliable aperture 18*c* generates the gripping force on that part of the yarn X which is required so that winding can take place at all (see principally FIG. 2*a*) and so that the yarn does not just "slip" on the yarn storage part during rotation of the winding part 16. In one embodiment the pliable aperture 18*c* suitably extended over 60% of the length of thread tube 18*a*, approximately 20% on its intake side and the remaining 20% on its outlet side being "absolutely open" so as to facilitate the passage of the yarn into or out of the thread tube 18a during the threading process. The parts of the insert section 18c designed to open said insert may be provided with toothed projections 18*cc* in order to increase the gripping force which the part applies to the relevant part of the yarn during winding. When, on completion of the threading, the machine again begins to use yarn from the thread regulator, the yarn is drawn out of the thread tube by the relatively large "pulling force" produced then, so that it recovers its normal position on the yarn storage part 17 during normal operation.

The exit brake 6' is shown only in outline in its position and in an embodiment may be located on the yarn storing part 17. The end of the yarn may be drawn/threaded through the brake element on the brakes 2', 6', or alternatively in an initial threading phase may be led somewhat to the side of the brake element/elements respectively, performing the actual braking. In a later phase of the threading, those strands of yarn affected are guided/laterally deflected in between the operating parts of the brake element. The lateral deflection is suitably achieved by stretching the yarn, for example where brake elements of plate-like construction are used. Where necessary the yarn may be laterally deflected by other means, no special element being used here.

FIG. 2 shows a combined yarn cleaning and yarn-end catching element 33, 34 on the inlet to and exit from part 12 (cf. FIG. 1).

The elements 33, 34 are controlled by control elements 35 and 36 respectively, e.g. in the form of pneumatic (alt. hydraulic or electric) cylinders/pistons 37, 38 or 39, 40. The operating media are supplied to the latter element via valves 41 or 42 which, as a function of controls from the control units 10' or 10'''' connect a pressure source, not shown, (and "sump" in the event of hydraulic controls being used) to the respective side of the piston 38 or 40 via lines 43, 44 or 45, 46. By means of its controls, the elements 33, 34 can be shifted in the directions indicated by the arrows arrows 47, 48 (with and against the yarn feed direction). The elements 33, 34 work with a clamping jaw action or with an action coordinatable with the strand of yarn in question, which can be actuated or switched off in a known manner. The clamping and release directions are shown by the arrows 49, 50. The elements 33, 34 are positioned to catch the end of the yarn, for example after a yarn break, and to convey it towards intake 2*a*, 6*a* or 7*a* respectively. The elements 33, 34 may also be actuated in conjunction with the cleaning function, any yarn remaining in brake 2' and on the thread regulator 1' (yarn storage part 17) being cleared away through the longitudinal displacement movements in the elements 33, 34. Where the take-off lengths are long in relation to the stroke lengths of elements 33, 34, the elements 33, 34 may be arranged in such a way that they "embrace" the yarn, i.e. be deactuated at one point and shifted longitudinally forwards or backwards in the inoperative state to be then actuated at another point on the yarn and shifted longitudinally again etc. In this case any yarnstretching function can be achieved by means of ejectors or other stretching function, e.g. with the aid of or in the exit brake. The elements 33, 34 can be divided in the figure plan in FIG. 2 and may be shifted clear of the yarn path during operation (weaving or the like). A transducer element 51 is positioned in order to detect when threading is effected through brake 2' and thread regulator 1' and gives an "acknowledgement" signal to the control unit 10'' when the end of the yarn reaches the relevant transducer.

The brake 2' may be fitted with a hood-shaped part 2*f*, which forms an inner chamber 2*g*, which is essentially sealed off from the surrounding atmosphere owing to the fact that the hood (the brake), located directly against the rear end of the thread regulator 15*a*, is effectively pressure tight. Alternatively the shell part on the brake may be of open design so that unrestricted access is obtained to internal elements/working brake elements for the removal of dust, carrying out servicing etc.

Figure 3:
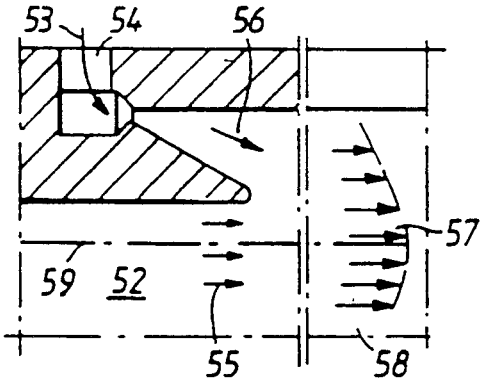
FIG. 3 shows parts of an ejector represented in the equipment according to FIG. 1 and FIG. 2 in longitudinal section.

FIG. 3 shows an ejector arrangement which can be used with the invention. The yarn feed duct shown by 52 and the working medium supply 53 takes place via the intake duct 54. The flow of air in the duct is shown by 55 and the air accelerated in the ejector by 56. The flow pattern after the ejector is shown by 57. The pressure distribution in the duct is shown by 58, and it will be seen that the pressure is greatest along the duct's longitudinal axis 59. In this way the end of the yarn/the yarn is attracted to the central parts of the duct as it is propelled.

Figure 4:
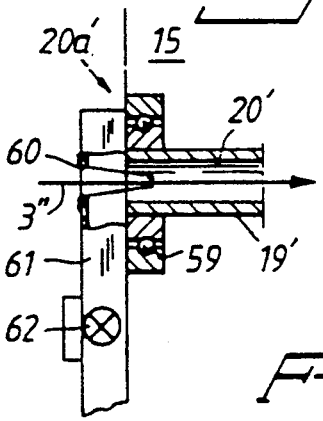
FIGS. 4–4*a* show an ejector arrangement in the said equipment in longitudinal and in vertical section respectively.
Figure 4A:
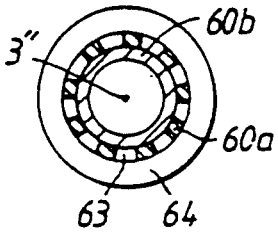

FIG. 4, 4*a* show examples of an ejector arrangement on the inlet 20*a'* to the first duct 20' for the yarn 3''. The bearing for the rotatable shaft 19 on the static shell and motor section 15 is shown by 59. The ejector element, which is described in more detail below, is denoted by 60, the air flow intake duct is show by 61, and a valve in the duct by 62. The shell of the ejector 60 has an annular section 60*b*, see FIG. 4*a*, and has parts 60*a* extending radially outwards to form air intake passages 63 between the parts 60*a*. The intake passages are defined/formed by means of the encompassing cylindrical part 64.

Figure 5:
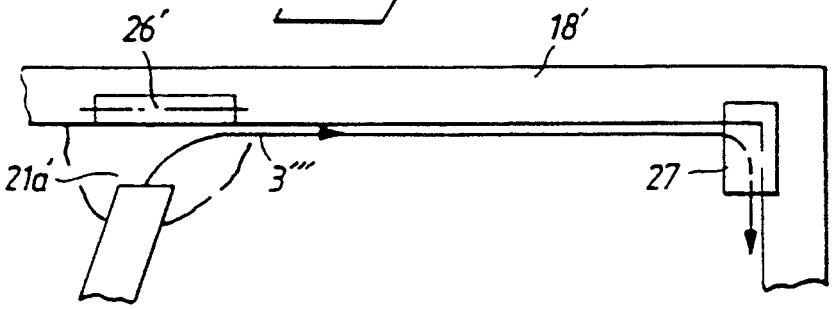
FIG. 5 shows a side view of further ejector arrangements on the front (dolling) section of the thread regulator.
Figure 6:
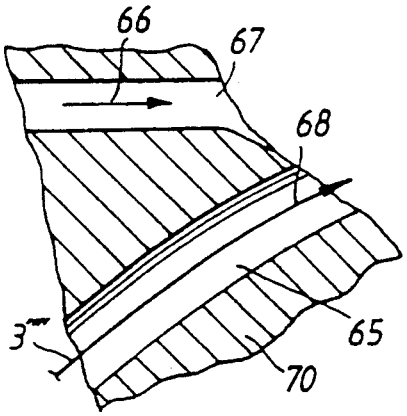
FIG. 6 shows an ejector arrangement on the outlet orifice of the winding tube in longitudinal section.
Figure 7:
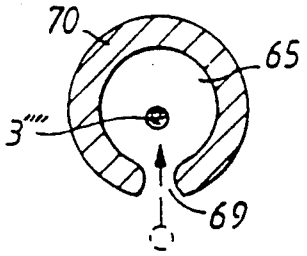
FIG. 7 shows parts of the ejector according to FIG. 6 in vertical section.

FIG. 5 shows principally possible ejector arrangements 26' on the exit orifice 21*a'* on the winding tube and 27' on part 18'. The ejector 26' is described in more detail in connection with FIGS. 6 and 7. In these figures the duct is shown by 65 and a duct for the propelling medium (air) by 66 by 67. The yarn 3'''' is fed in the direction 68. The duct 65 is formed with an aperture 69 directed downwards to permit lateral insertion and removal of the yarn 3''''. The shell part of the ejector is denoted by 70.

Figure 8:
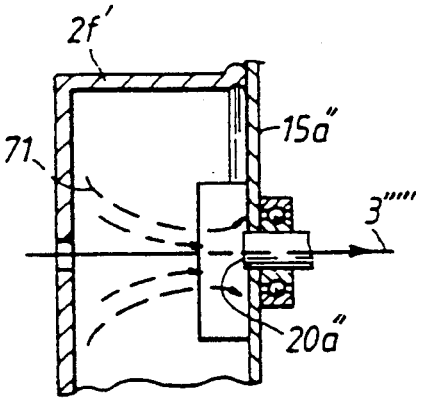
FIG. 8 shows parts of the intake thread brake and the thread regulator in longitudinal section.

FIG. 8 shows how the hood 2*f'* is sealed towards the end 15*a''*. With the open embodiment of the intake brake, a medium flow pattern is set up as shown by the arrows 71, the medium flow having a form which results in the yarn 3''''' being attracted towards the orifice 20*a''*.

Figure 9:
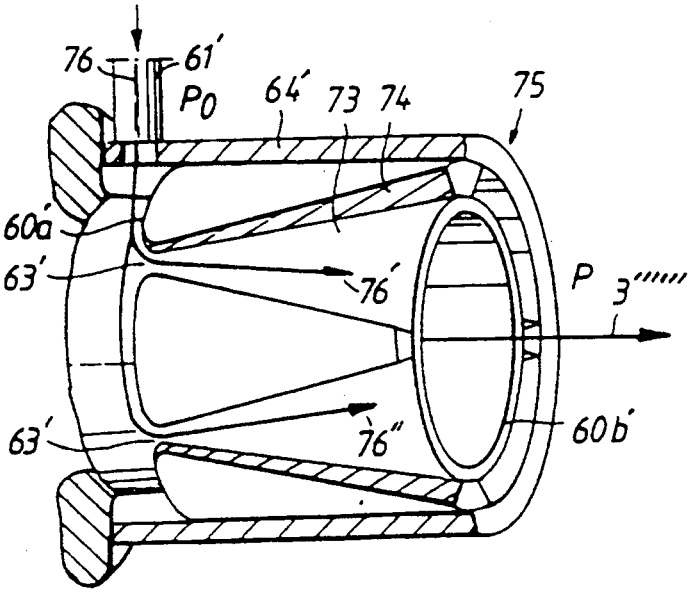
FIG. 9 shows a perspective view obliquely from the front, of a constructive design for an ejector.
Figure 10:
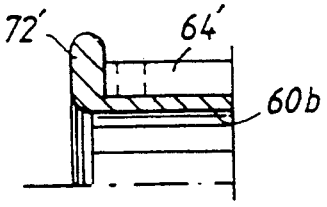
FIG. 10 shows parts of the ejector according to FIG. 9 in longitudinal section.

FIGS. 9 and 10 show a powerful ejector arrangement suitable for application in accordance with FIG. 4, in relation to which FIGS. 9 and 10 have the same reference designations for certain parts but with the addition of prime symbols. The ejector is suitable for fitting to an inlet to a duct, for example the first duct's inlet 20*a* (see FIG. 2) and has a flange 72' designed to bear against a plane surface (cf end 15*a* in FIG. 2). The ejector shell is designed with depressions or outlet ducts 73, which widen in conformity from the intake orifices 63'. One wall of the depression is indicated by 74. The thickness of this wall may be increased towards the outlet end 75 of the ejector, through which the yarn 3'''''' is fed out. The inside surface of the ejector thus narrows somewhat in conformity towards the end 75. An incoming working medium is indicated by 76. The working medium passes the inlet 63' and is accelerated in the direction of the arrows 76' and 76''. On the widened exit passages of the outlet ducts for the working medium at the end of the ejector the accelerated medium (air) combines with the air flow in the duct (=ejector's central duct), cf. principle according to FIG. 3. The process according to the invention is implicitly described in the above description of this embodiment.

In the threading process the end of the yarn is brought towards the intake aperture 2*a*. Where necessary, the brake element 2*b*, 2*c*, 2*d* is deactuated by means of the control unit 14'. Similarly any transducer 22 may be deactuated so as to facilitate threading. In connection with the presentation/application/positioning of the yarn end, the unit 10''' activates the ejector control 13', which results in starting of the ejector function. Any connected ducts/chambers are evacuated, preferably but not exclusively by using a pulsating flow of working medium, in a predetermined period of time, preferably in the extent of a few seconds. The medium flow pattern between the brake 2 and the thread regulator 1 is established and the yarn is fed in by the suction/-partial vacuum occurring further ahead on the path. The yarn feed is controlled so that a constant or varied yarn feed is obtained, variations being achieved through (temporary) preferably pulsating yarn braking measures or preferably pulsating medium changing measures. The yarn passes in through the ducts 20, 21 and out via the outlet 21*a*. The ejectors 26, 27 and 28 transport the yarn on its way towards the exit eye 18*a*, where the sensor element 51 indicates the presence of the yarn end, which is fed on to any exit brake in operation and on to the textile machine 7'. The ejectors are deactuated via the control unit 10'' and the unit 13', and the brake is activated from the unit 14' when threading has been achieved. Following a yarn break or in the event of any other interruption to the weaving process, the yarn cleaning equipment 33, 35 and 34, 36 is used. The control units 10' and 10'''' activate the cleaning equipment in order to remove any remaining yarn from the system. After cleaning, a new yarn end can be fed to the intake 2*a* by means of the element 33, which is positioned to catch the yarn end and to deliver this to the aperture 2*a*, according to the controls from the unit 10'. Threading is then repeated as described above. With ready-entered yarn the elements 33, 34 are shifted to the side so as not to disrupt normal operation. In principle the equipment 33, 34 for catching, cleaning and delivering the yarn end can be incorporated on the intake side with the intake brake or parts thereof, or vice versa, and on the exit side with the exit brake or parts thereof, or vice versa.

The more or less independently operating cleaning function with any associated cropping function can be used in a specific manner. The equipment is arranged so that the yarn cleaning is actuated in a preferably similar way, in one embodiment in exactly the same way, each time a defect in the form of a yarn break, yarn tangling, yarn obstructions or an indication of defective or deficient yarn occurs, or if an incorrect signal, i.e. a false alarm is given or there is an error in the program, etc., or if working is to be interrupted for some other reason (change of operating mode, e.g. weaving pattern, etc.). Yarn cleaning may thereby be carried out in a similar manner in the event of each fault signal, regardless of where the fault occurs in the yarn path or what the cause of the fault is or whether it is a case of a "false alarm". This function may be suitably programmed into the software on which the control unit operates or is supplied with. Specific advantages are attained thereby in the case of weaving of "parallel yarns" (simultaneous introduction of more than one weft yarn on each shot). In one embodiment the elements 33, 34 may form two parts extending essentially parallel in the longitudinal direction which when combined grip the yarn and carry its end towards the inlet 2*a* of the brake. The parts may thereby be relieved in rllation to one another so as to form a duct which can be Joined to the said first and second ducts and the interior of the brake 2, from which first-named duct the yarn end can be sucked in through the aperture 2*a* and on into the first and second ducts. Alternatively the parts may enclose internal delivery elements which mechanically transport or feed the yarn end to the parts' outlet aperture, which are moved in conjunction with the opening of the brake 2*a*. The parts of the elements 33, 34 moving with one another and working with the yarn can be controlled by means of suitable pneumatic working arrangements (not shown), which can be operated from the respective control unit/part of the control unit concerned. In one embodiment the yarn break-detecting and/or cause-detecting element is initiated by signals from the yarn break or cause sensor(s), of which the cause sensor(s) in particular may be manually influenced or actuated. The respective indicator of the said indicators then in turn actuates the parts of the elements 33, 35 or 34, 36 so that cleaning will always take place whenever there is a signal from the sensor. An embodiment with parts which, according to the influence, create a static electrical field and are retained by this in parts concerned may also be used. Delivery of the yarn end to the aperture 2*a* and deactivation of the said static field is thereby coordinated from the control unit(s) involved. In one embodiment an ejector/ejectors is/are used for the cleaning function, it being possible on the front to use the same ejector(s) for cleaning as is/are used in threading. Each ejector thereby works in two different modes, threading mode and cleaning mode, which is controlled from the unit concerned. On the rear end of the thread regulator an ejector assigned for cleaning can be used, cf. elements 33, 34.

In one embodiment, an ejector according to the above is used for or with through-holes and thereby comprises one or more Laval nozzles arranged around the periphery according to FIGS. 3 and 9. The nozzles may be of round type or be formed with a rectangular cross-section. Despite the fact that they are very small (a few millimeters), there is, according to commonly known theories, no problem from the design standpoint. Owing to the fact that such an ejector depends on the thickness of the boundary layer and the heat yield with regard to the walls, a mouthpiece formed in this way will be underexpanding, making reliable design easy to achieve..

A pressure differential P/Po (where Po is the feed pressure and P is the pressure in the yarn tube) at the orifice of the ejector mouthpiece of less than 0.528 would have to selected in order to obtain the critical flow and hence a supersonic speed in the jet.

In one embodiment where P/Po is 0.2724 (=3.67 bar gauge) an exit speed of 1.5× the speed of sound and A/At=1.176 (where A is area of the minimum cross-section of the outlet duct and At=the area of the orifice) is obtained. The ratio within the range 0.15–0.50 is particularly consistent with the concept of the invention.

If a rectangular-shaped mouthpiece is selected and the width at the minimum cross-section of the outlet duct is approximately 1 mm, the outlet width will be approximately 1.2 mm. From this it can be seen with greatly exaggerated dimensions. However, this was done with the intention of accomplishing a clear reproduction of the function principle. As will be seen from FIGS. 3 and 9, the duct may be widened in the radial plane or the tangential plane. The inner part of the ejector may suitably be made of ceramic material, since the "yarn eye" may also be formed in this way.

A combined threading and cleaning system is shown in FIG. 1l which includes the thread regulator 78, intake and exit thread brakes 79, 80, 80', yarn sensors 81, 82, 83 and 84, yarn doffers (yarn cleaners) 85, 86 and cropping devices 87 and 88. The system can be set up for various applications. When feeding two or more yarns 89, 90, 91, 92 in parallel, the cropping elements 87 and/or 88 are used in order to cut off the possibly unbroken threads of the parallel yarns. The said parts are shown spread out in the drawing plane for the sake of clarity. The parts may be integrated or separate, as is most suitable. In this case ejectors 94, 95, 96 are included, which may be supplemented by (a) further ejector(s). The yarn doffers 85 and 86 may be of the ejector type. The position of the bobbin is indicated by 97. A control unit is symbolised by 98. The control unit can communicate with a respective part of the system according to FIG. 11 via a communication and function exercising unit, two such units being indicated by 99 and 100. One or more of the units may communicate directly with the control unit 98, which in turn may be connected to an overriding element via a connection 102.

Figure 11:
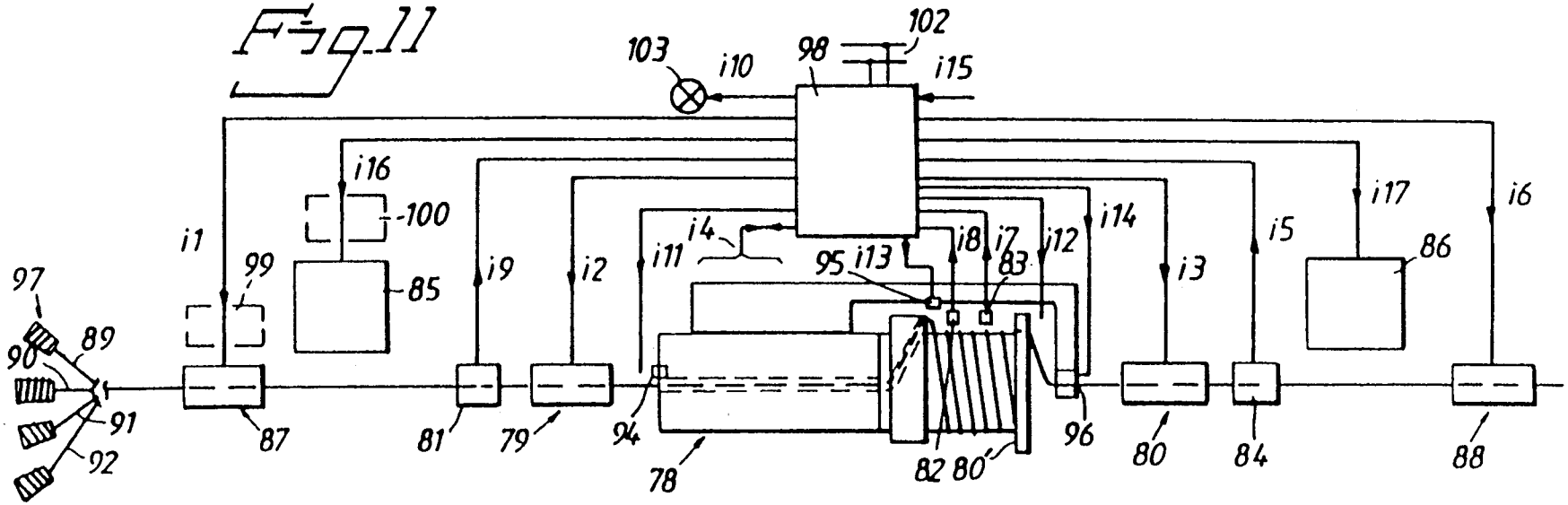
FIG. 11 shows a general diagram of thread regulator, intake and exit brakes in a complete system with automatic cleaning and cropping functions.

A threading sequence with the equipment according to FIG. 11 may be supplied as follows:

1. Activate the cropping element 87 so that the threads are cropped behind the inlet (towards the bobbin position) and activate the brakes 79, 80 for opening;
2. Clear the spool body forwards until the transducer 84 indicates "no presence of thread" or a certain time has elapsed (e,g, 5 secs), Activate the cropping element 88 on the exit (after the exit brake 80);
3. Clear the spool body backwards without turning the winding sheave/winding element until the transducers 81, 82, 83, 84 do not signal the presence of thread or a certain time has elapsed (e.g. 5 secs);
4. If any of the transducers indicates the presence of thread, continue clearing backwards by slowly turning the winding sheave backwards until the transducers do not register the presence of thread, or by turning the sheave backwards for a predetermined length of time (e.g. 5 secs);
5. If any of the transducers continues to register the presence of thread (yarn), clearing has been unsuccessful and a signal for summoning the operator is initiated;
6. If clearing has been achieved, activate the ejectors (94, 95 and/or 96, etc.) for blowing;
7. New thread or new threads are presented at the inlet in question;
8. When thread is registered on the transducer 84 the ejectors' blowing sequence is interrupted;
9. The brakes 79, 80, 80' are (all) activated for application and the winding sheave is rotated forwards until the transducers 82 and 83 signal that the yarn storage is full.

Threading with associated cleaning is now complete. The sequence can be used for one or more parallel threads.

The yarn doffer(s) 85 and/or 86 work with an ejector or nozzle function. In one embodiment the function is arranged so that the Jet of medium "attacks" the yarn-/yarns at an angle, e.g. at right angles. The element catching the severed yarn can thereby be positioned on the opposite side of the yarn to the yarn doffer. In a further embodiment the ejector and nozzle function are positioned so that the relevant elements (cf. 33, 34) can be applied direct to the aperture *2a* with subsequent extraction/clearing.

The cropping element 87 is activated by means of a command signal il to the cropping element/its unit 99. The cropping element may take the form of a known controllable cropping element. Activation of the brakes 79 and 80 is performed by i2 and i3 respectively. An exchange of signals between the control unit and the thread regulator is shown by i4. At this exchange of signals the winding sheave is rotated in backwards and forwards directions.

The signal from the transducer 84 is shownby i5. The cropping element is controlled by a signal i6. The signals from the transducers 81, 82 and 83 are indicated by i7, i8 and i9. Any signal to signalling element 103 (summoning of operator) is shown by i10. The brake 80' is controlled by a signal i12 and the ejectors by ill, i13 and i14. A cause signal i15 may emanate from an automatic or manual action if there is a reason to stop the machine, which means that a new threading and cleaning process has to be initiated. The control signals to the doffers 85, 86 are shown by i16, i17.

The present invention is not restricted to the embodiments described above and shown in the drawings but can be subjected to a number of modifications within the framework of the following patent claims and the object of the invention. By way of an example, an alternative embodiment with regard to the threading is shown in FIGS. 12–14 which, as stated previously at several points, the threading is carried out "blind" and in exactly the same way each time that a fault is registered, i.e. regardless of where any fault, e.g. yarn break, occurs (FIG. 13 shows a yarn brake on the yarn storage bobbin, i.e. upstream of the thread regulator, whilst FIG. 14 shows a yarn break in the loom's grippers, i e. downstream of the thread regulator), or the fault signal was a "false alarm" (FIG. 12 shows an instance of this).

In this embodiment, ejectors are fitted suitably at all the positions marked with arrows in and on the thread regulator, a device for transverse blowing of the yarn on the exit from the thread regulator, together with a device for cropping of the yarn in conjunction with the said transverse blowing. The ejectors and the transverse blowing device are preferably arranged so that they are activated at the same time, for the sake of simplicity. Clearance blowing can likewise be performed forwards each time there is a fault signal, regardless of the type or position of the fault or whether there is a "false alarm".

It is worthwhile pointing out, however, that one exception may be provided for, that is, namely, for when the yarn breaks at the mouth of the winding tube and the yarn, contrary to expectation, at the same time remains firm on the storage bobbin, in which case, in view of the small probability of this type of fault, it might be appropriate to provide a separate fault signal to cover this unusual instance, and, in the case of this occurring, to be able to perform backward clearance blowing (reversing of the winding sheave is not required in this case). Alternatively in this case the element for applying a "new" yarn to the thread regulator intake can be contrived in any suitable manner, e.g. by means of any design suitable for the purpose (furnished with a hook-shaped element, for example) to draw the end of the yarn remaining in the winding tube out of said winding tube and out of the thread regulator.

An exemplary sequence of steps for the embodiment shown in FIGS. 12–14 is as follows. In FIGS. 12A–14A, open all yarn brakes and position the thread regulator in the threading mode, i.e. the winding tube 21*a* is in line with the thread tube 18*a*. In FIGS. 12B–14B, let all ejectors blow for 3 seconds. In FIGS. 12C–14C, crop the yarn/yarn ends at the thread regulator exit. In FIGS. 12D–14D, start the thread regulator, i.e. start the winding of yarn onto the yarn storage part of the thread regulator. In FIGS. 12E and 14E, check for a signal from the detector(s) in the thread regulator which senses the amount of yarn stored on the storage part (the detector(s) signals the presence of yarn on the yarn storage section so that the thread regulator motor stops). In FIGS. 12F and 14F, the thread regulator stops and everything is in order, i.e. threading has been completed in a satisfactory manner. However, in FIG. 13D, the thread regulator does not stop which means that threading has not been completed (this is the case in which the yarn has broken on the bobbin such that the "same" yarn cannot be automatically threaded up again and "new" yarn, for example from another defect-free bobbin, must be threaded through the thread regulator). In FIG. 13D, the thread regulator is repositioned in the threading position. Once in the threading position, all of the ejectors blow while a "new" yarn is applied to the inlet of the intake brake. In FIG. 13E, the ejectors are stopped after 1 second, and the yarn at the exit of the thread regulator is cropped. In FIG. 13F, the thread regulator is started, i.e. start the winding of yarn onto the yarn storage part of the thread regulator.

Figure 15:
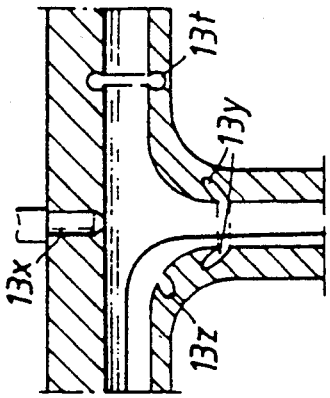
FIG. 15 shows, in longitudinal section, an embodiment of a device for "transverse blowing" of the yarn at the exit from the thread regulator, for use, for example, in the embodiment according to FIGS. 12A–14.
Figure 12A:
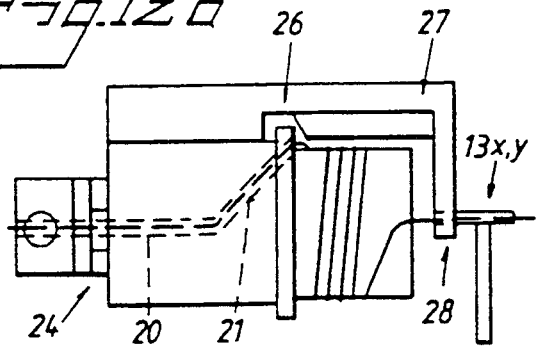
FIGS. 12A–14 show the sequence of events in a blow-cleaning and threading process in one embodiment of the invention.
Figure 12B:
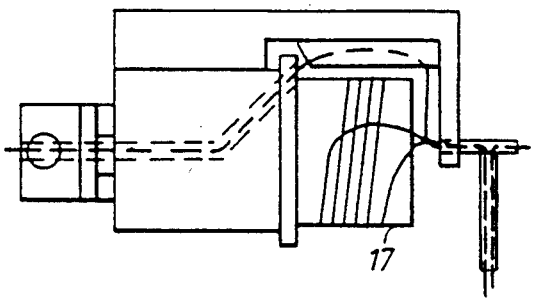
Figure 12C:
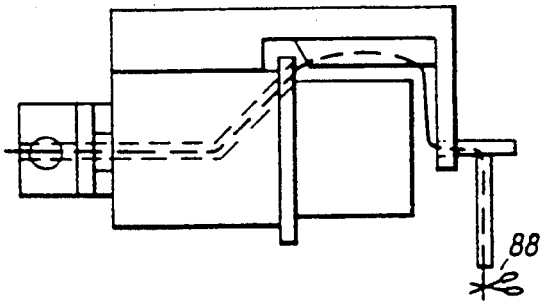
Figure 12D:
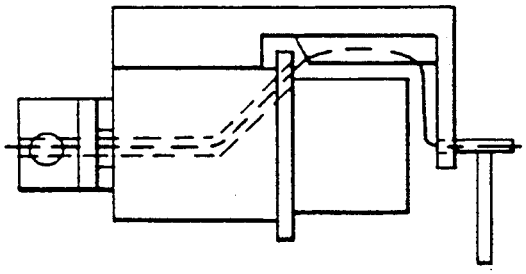
Figure 12E:
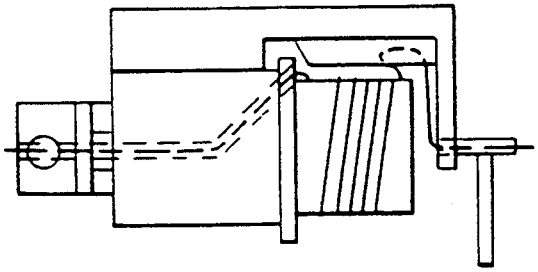
Figure 12F:
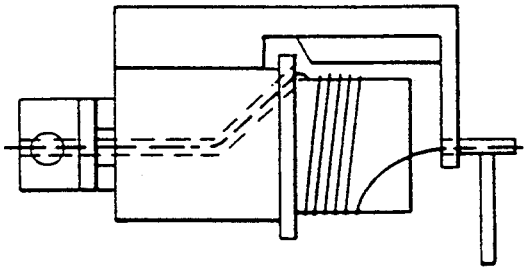
Figure 13A:
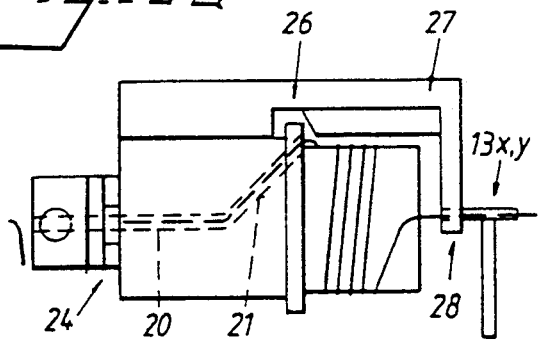
Figure 13B:
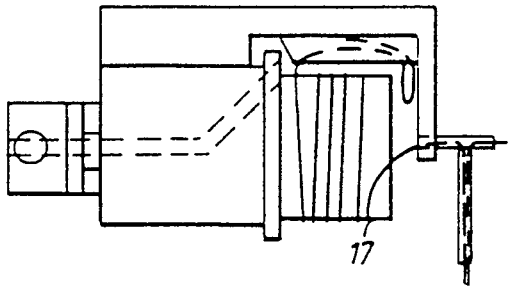
Figure 13C:
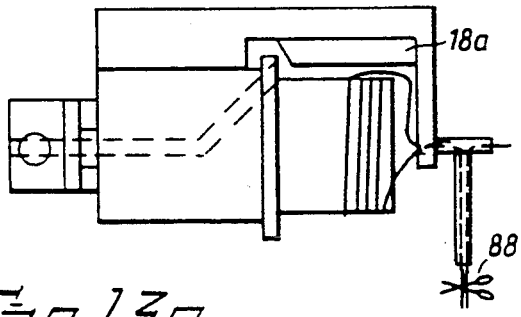
Figure 13D:
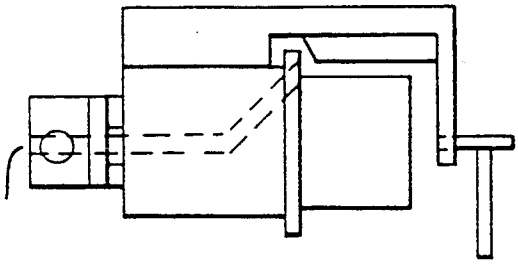
Figure 13E:
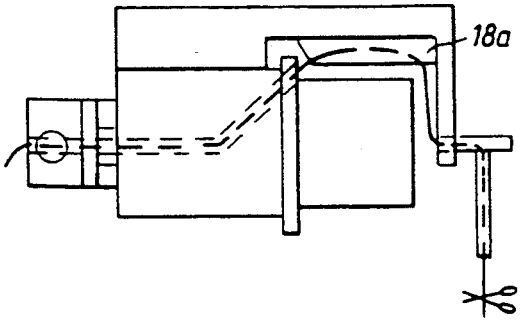
Figure 13F:
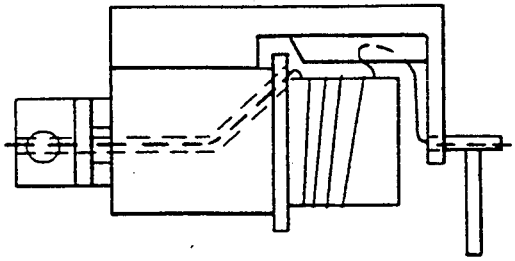
Figure 14A:
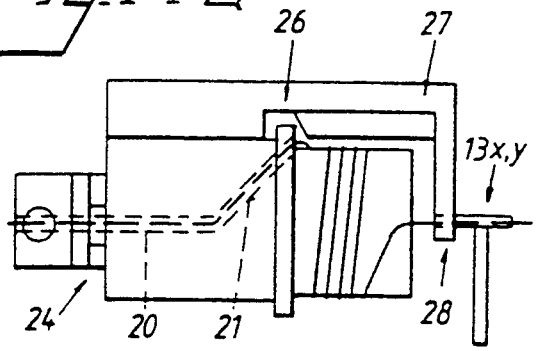
Figure 14B:
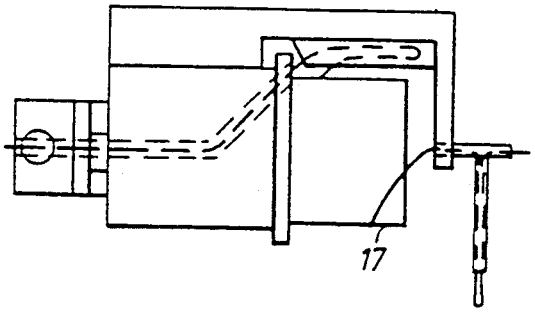
Figure 14C:
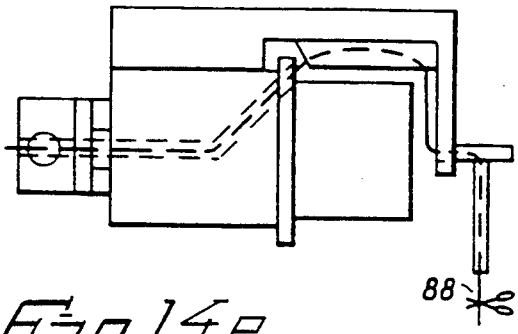
Figure 14D:
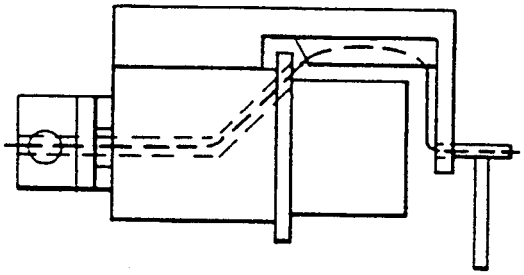
Figure 14E:
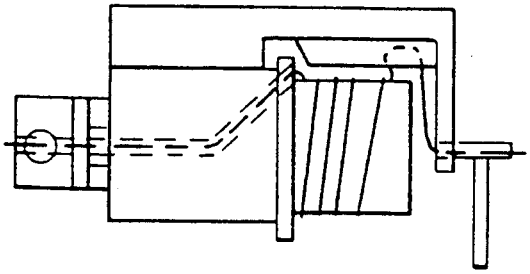
Figure 14F:
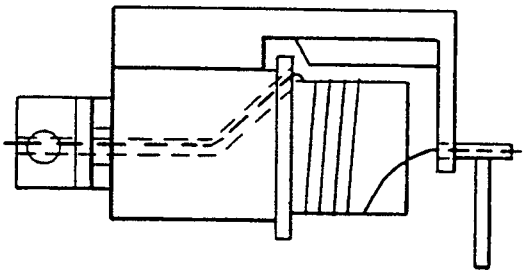

The possible embodiments, shown in FIG. 15, of a device for "transverse blowing" of the yarn at the thread regulator exit, comprises an air mouthpiece 13*x* of "supersonic" type and/or an annular ejector 13*y* on the transverse part of the device which serves for "transverse blowing" of the yarn in the device, whilst a further mouthpiece 13*z* of "supersonic" type and/or an annular ejector 13*t* serves for refeeding of the yarn in the longitudinal direction of the thread regulator.

I claim:

1. A thread feeding system comprising:

at least one thread regulator having a fixed housing; a hollow tubular shaft extending through the fixed housing, the shaft being rotatable around a longitudinal central axis of the housing; a rotatable winding section positioned coaxially adjacent a downstream end of the fixed housing and secured to the rotatable shaft; a thread duct extending through the thread regulator, the thread duct having a first duct portion extending through the tubular shart, a second duct portion extending through the winding section at an angle with respect to the first duct portion, and an angled duct portion coupling the first duct portion to the second duct portion; an inlet positioned at an upstream end of the first duct portion; and a plurality of ejectors positioned within the duct portions, the ejectors supplying a working medium from a pressurized working medium source to the duct portions to facilitate threading of a thread through the thread duct, the inlet receiving a free end of the thread from a thread spool assembly disposed upstream from the thread regulator;

control means for controlling the ejectors so that the ejectors generate a pressure proximate to the inlet to develop a flow of the working medium into the inlet; and pulsating means for feeding the thread through the thread regulator in a pulsating manner to insure that the free end of the thread passes unobstructed through the thread duct.

2. The thread feeding system as claimed in claim 1, wherein the pulsating means includes means for varying the flow of working medium supplied to the duct portions.

3. The thread feeding system as claimed in claim 1, wherein an intake thread brake is positioned upstream from the thread regulator, the thread brake including an aperture positioned at an upstream end of a thread path extending through the thread brake, the aperture receiving the free end of the thread from the thread spool assembly disposed upstream from the thread brake, means for applying a braking force to the thread passing along the thread path, and at lesat one second ejector positioned along the thread path wherein said second ejector supplies the working medium to the thread path to facilitate threading of the thread through the thread brake;

the control means including means for controlling the second ejector to generate a second pressure proximate to the aperture which is greater than the first-mentioned pressure, the first-mentioned ejectors and the second ejector cooperating to develop the flow of the working medium through the thread path and the thread duct;

whereby the pulsating means feeds the thread through the thread brake and the thread regulator in the pulsating manner to insure that the free end of the thread passes unobstructedly through the thread duct.

4. The thread feeding system as claimed in claim 1, wherein the thread feeding system further comprises means for automatically conveying the free end of the thread to the aperture of the thread brake, and means for automatically conveying the free end of the thread from a downstream end of the second duct portion along a second thread path to at least one additional component of the thread feeding system disposed downstream from the thread regulator.

5. The thread feeding system as claimed in claim 3, wherein the intake thread brake is mechanically secured to an upstream end of the thread regulator so that the thread path is positioned at the inlet of the first duct portion.

6. The thread feeding system as claimed in claim 3, wherein the means for applying the braking force includes a plurality of brake elements acting on the thread along the thread path, and wherein the control means further includes means for controlling the brake elements to effect the braking force applied to the thread.

7. The thread feeding system as claimed in claim 3, wherein the control means further includes means for controlling the thread regulator and the thread brake in unison during a continuous thread feeding operation, and means for separately controlling the thread brake during a threading-up operation.

8. The thread feeding system as claimed in claim 3, wherein the control means further includes at least one control unit.

9. The thread feeding system as claimed in claim 3, wherein at least one of the ejectors includes a through-duct for receiving at least one said thread, and produces an outlet pressure to feed pressure ratio in a range of about 0.15 to about 0.52.

10. The thread feeding system as claimed in claim 9, wherein the outlet pressure to feed pressure ration is in a range of about 0.20 to about 0.40.

11. The thread feeding system as claimed in claim 9, wherein a ratio between a minimum cross-section area of an outlet duct to a cross-sectional area of an intake orifice is in a range of about 0.10 to about 0.25.

12. The thread feeding system as claimed in claim 11, wherein a ratio between a minimum cross-sectional area of an outlet duct to a cross-sectional area of an intake orifice is about 0.18.

13. The thread feeding system as claimed in claim 11, wherein the outlet duct widens radially in a downstream direction relative to the thread duct.

14. The thread feeding system as claimed in claim 11, wherein the outlet duct widens circumferentially in a downstream direction relative to the thread duct.

15. The thread feeding system as claimed in claim 3, wherein the thread feeding system further comprises means for automatically detecting the occurrence of a thread break.

16. The thread feeding system as claimed in claim 15, wherein the thread feeding system further comprises first means for automatically removing a first residual portion of the thread from at least the thread path of the thread brake after the thread break occurs, and second means for automatically removing a second residual portion of the thread from at least the thread duct of the thread regulator after the thread break occurs.

17. The thread feeding system as claimed in claim 16, wherein the first and second automatic removing means each include a member which operates reciprocally along the thread path and the thread duct.

18. The thread feeding system as claimed in claim 16, wherein the control means further includes means for controlling the first and second automatic removing means in response to the automatic detecting means.

19. The thread feeding system as claimed in claim 15, wherein the automatic detecting means includes means for determining the presence and/or absence of the thread from the thread path and the thread duct.

20. The thread feeding system as claimed in claim 3, wherein the thread feeding system further comprises means for automatically conveying the free end of the thread to the aperture of the thread brake.

21. The thread feeding system as claimed in claim 20, wherein the thread feeding system further comprises second means for automatically conveying the free end of the thread from a downstream end of the second duct portion along a second thread path to at least one additional component of the thread feeding system disposed downstream from the thread regulator.

22. The thread feeding system as claimed in claim 21, wherein the additional component includes an exit thread brake.

23. The thread feeding system as claimed in claim 21, wherein the control means further includes means for controlling the first-mentioned and second automatic conveying means.

24. The thread feeding system as claimed in claim 21, wherein the first-mentioned automatic conveying means includes first means for automatically removing a first residual portion of the thread from at least the thread path of the thread brake after a thread break occurs, and the second automatic conveying means includes second means for automatically removing a second residual portion of the thread from at least the thread duct of the thread regulator after the thread break occurs.

25. The thread feeding system as claimed in claim 24, wherein the control means further includes means for controlling the first and second automatic removing means.

26. The thread feeding system as claimed in claim 21, wherein the first-mentioned and second automatic conveying means each include a member which operates reciprocally along the respective first-mentioned and second thread paths.

27. The thread feeding system as claimed in claim 6, wherein the pulsating means includes means for varying at least one of (1) the braking force applied by the brake elements, and (2) the working medium supplied to the ejectors.

28. The thread feeding system as claimed in claim 6, wherein control means further includes means for repositioning at least one of the brake elements into a non-braking position during a threading-up operation.

29. The thread feeding system as claimed in claim 28, wherein the means for repositioning includes means for automatically repositioning the at least one of the brake elements.

30. The thread feeding system as claimed in claim 28, wherein the means for repositioning includes means for manually repositioning the at least one of the brake elements.

31. A method for feeding a thread into a thread feeding system, the thread feeding system including at least one thread regulator having a fixed housing; a hollow tubular shaft extending through the fixed housing, the shaft being rotatable around a longitudinal central axis of the housing; a rotatable winding section positioned coaxially adjacent a downstream end of the fixed housing and secured to the rotatable shaft; a thread duct extending through the thread regulator, the thread duct having a first duct portion extending through the tubular shaft, a second duct portion extending through the winding section at an angle with respect to the first duct portion, and an angled duct portion coupling the first duct portion to the second duct portion; an inlet positioned at an upstream end of the first duct portion; and a plurality of ejectors positioned within the duct portions, the ejectors supplying a first flow of working medium from a pressurized working medium source to the duct portions to facilitate threading of a thread through the thread duct, the method comprising the steps of:

conveying a free end of the thread to the inlet;

actuating at least one of the ejectors to develop a second flow of the working medium into the inlet; and feeding the free end of the thread through the thread regulator in a pulsating manner to insure that the free end of the thread passes unobstructedly through the angled thread duct.

32. The method as claimed in claim 31, wherein the feeding the free end step includes the sub-step of varying the first flow of working medium supplied to the at least one of the ejectors in a pulsating manner.

* * * * *

UNITED STATES PATENT AND TRADEMARK OFFICE

CERTIFICATE OF CORRECTION

PATENT NO. : 5 343 898

DATED : September 6, 1994

INVENTOR(S) : Lars-Berno FREDRIKSSON

It is certified that error appears in the above-indentified patent and that said Letters Patent is hereby corrected as shown below:

Column 14, line 7; change "shart," to ---shaft,---.

line 41; change "lesat" to ---least---.

Column 15, line 25; change "ration" to ---ratio---.

line 28; change "cross-section" to ---cross-sectional---.

line 32; change "a ratio" to ---the ratio---.

line 32; change "a minimum" to ---the minimum---.

line 33; change "an outlet" to ---the outlet---.

line 33; change "a cross-sectional" to ---the cross-sectional---.

line 33; change "an intake" to ---the intake---.

Column 17, line 1; change "a thread" to ---the thread---.

Signed and Sealed this

Twenty-seventh Day of December, 1994

*Attest:*

*Attesting Officer*

BRUCE LEHMAN

*Commissioner of Patents and Trademarks*